US006758744B1

(12) United States Patent
Dai

(10) Patent No.: US 6,758,744 B1
(45) Date of Patent: Jul. 6, 2004

(54) BUILDING INTERIOR AIR PRESSURE CONTROL SYSTEM

(76) Inventor: Rongqing Dai, 301 Kraemer Ct., East Brunswick, NJ (US) 08816

( * ) Notice: Subject to any disclaimer, the term of this patent is extended or adjusted under 35 U.S.C. 154(b) by 0 days.

(21) Appl. No.: 10/413,197

(22) Filed: Apr. 14, 2003

Related U.S. Application Data

(60) Provisional application No. 60/455,143, filed on Mar. 17, 2003.

(51) Int. Cl.[7] ..... F24F 7/00
(52) U.S. Cl. ..... 454/255; 454/238
(58) Field of Search ..... 454/187, 255, 454/238, 239, 256, 340

(56) References Cited

U.S. PATENT DOCUMENTS

| | | | | |
|---|---|---|---|---|
| 4,251,027 A | | 2/1981 | Dehart et al. | 236/49.4 |
| 4,372,373 A | * | 2/1983 | Haugeneder et al. | 165/54 |
| 4,552,058 A | | 11/1985 | Wooldridge | 454/238 |
| 4,705,066 A | | 11/1987 | Gut et al. | 137/486 |
| 4,902,315 A | | 2/1990 | Spicer | 95/273 |
| 4,905,578 A | | 3/1990 | Curtis et al. | 454/229 |
| 4,960,041 A | | 10/1990 | Kiser | 454/238 |
| 5,099,751 A | | 3/1992 | Newman et al. | 454/238 |
| 5,257,958 A | | 11/1993 | Jagers | 454/238 |
| 5,312,297 A | | 5/1994 | Dieckert et al. | 454/238 |
| 5,360,372 A | | 11/1994 | Newman et al. | 454/253 |
| 5,385,505 A | | 1/1995 | Sharp et al. | 454/238 |
| 5,545,086 A | | 8/1996 | Sharp et al. | 454/238 |
| 5,720,658 A | | 2/1998 | Belusa | 454/238 |
| 5,938,527 A | * | 8/1999 | Oshima et al. | 454/344 |
| 5,951,394 A | | 9/1999 | Pariseau | 454/61 |
| 5,997,399 A | * | 12/1999 | Szatmary | 454/187 |
| 6,033,302 A | | 3/2000 | Ahmed et al. | 454/238 |
| 6,267,666 B1 | * | 7/2001 | Wilhelmi | 454/292 |

* cited by examiner

*Primary Examiner*—Derek S. Boles

(57) ABSTRACT

A method for controlling building interior air pressure that is different from external environment air pressure, wherein the internal and external air pressure difference can be significantly large. The internal and external air pressure difference is maintained through partitioning the internal airway using permeable porous walls. A method for building the permeable porous walls using unit permeable porous blocks including boxes of granular particulates is provided to ease not only the installation but also the repair and replacement of the permeable porous walls, and also to maximize the reusability of the materials used to build the walls.

3 Claims, 9 Drawing Sheets

FIG 1B. $P_p < P_n$

FIG 1A. $P_p > P_n$

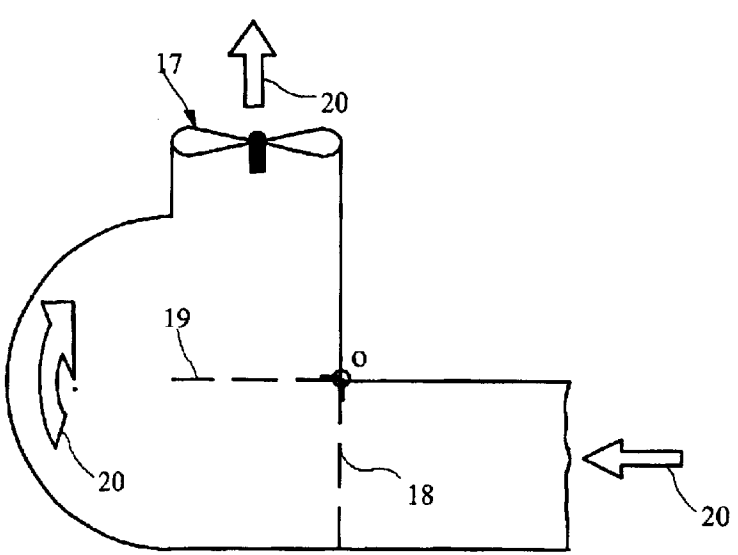
FIG 2B
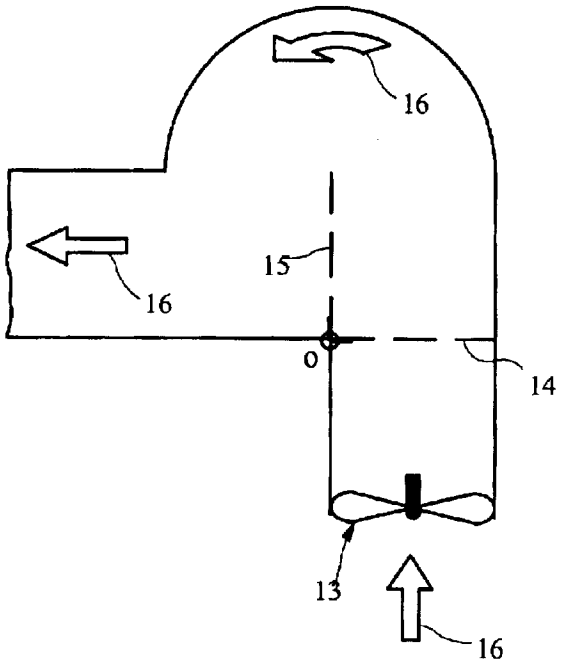
FIG 2A
FIG 2

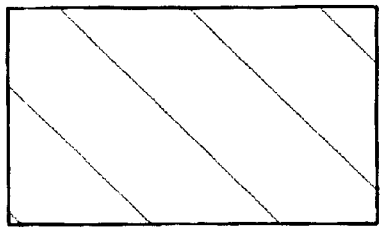
FIG 4C
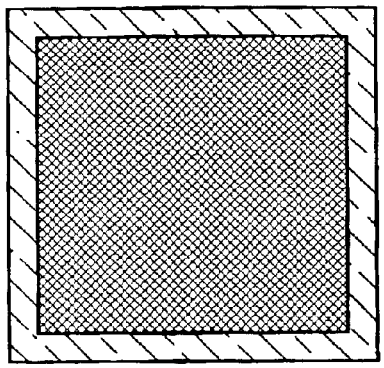
FIG 4B
FIG 4
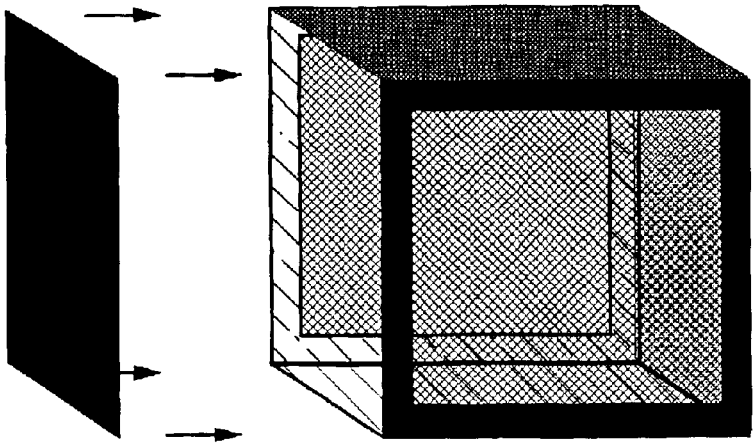
FIG 4A

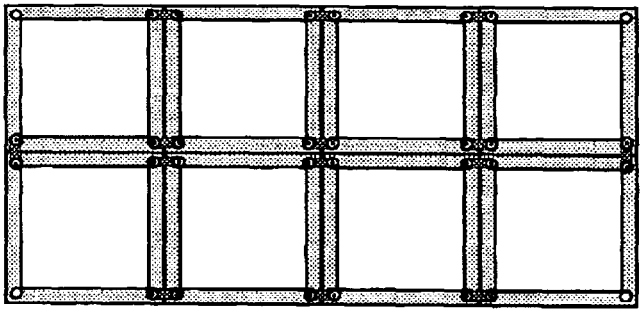
FIG 6D
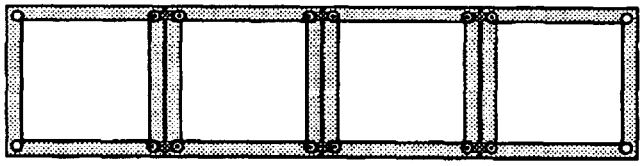
FIG 6C
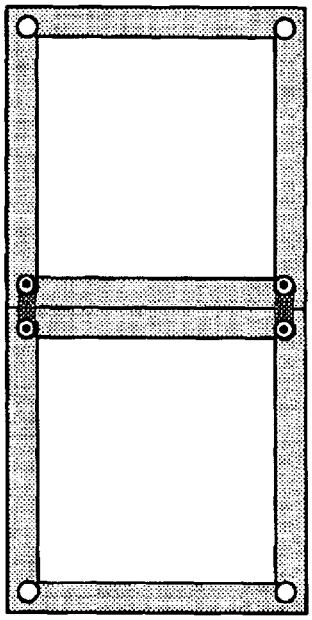
FIG 6B
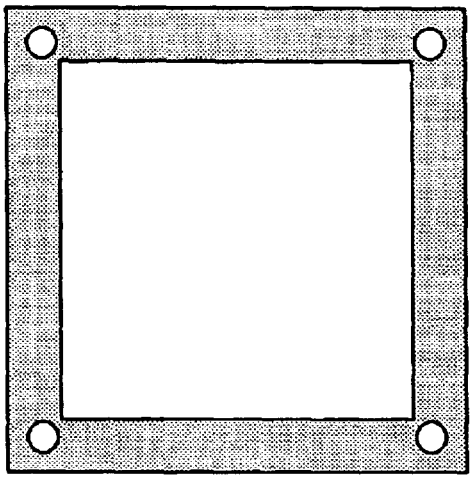
FIG 6A
FIG 6

BUILDING INTERIOR AIR PRESSURE CONTROL SYSTEM

CLAIM THE BENEFIT OF PREVIOUS PPA

I would like to claim the benefit of US Provisional patent application entitled "BUILDING INTERIOR AIR PRESSURE CONTROL SYSTEM" filed by myself (Rongqing Dai) with the filing date as Mar. 17, 2003, and application No. of 60/455,143.

TECHNICAL FIELD OF THE INVENTION

This invention relates generally to interior climate control systems and, more particularly, to climate control systems capable of controlling building interior air pressure that is different from the air pressure in external environment (e.g. atmosphere) and the difference can be significantly large.

BACKGROUND OF THE INVENTION

Air pressure is one of fundamental living conditions for human beings. While most of us take a comfortable air pressure (about 1 atmospheric pressure at sea level) as given during our daily lives, in certain circumstances, such as traveling to high altitude regions, people may feel the significance of the variation of surrounding air pressure or have the desire of staying in an area with air pressure much different from the external atmosphere.

In the past years, tremendous efforts have been devoted to control the interior climate within a building construction, such as temperature, humidity, freshness, and air pressure. However, compared to the control over other parameters, the achievements and applications of control over air pressure within building constructions have been quite limited.

Air pressure control, in comparison with other interior climate control mechanisms, is more difficult for the fact that pressure difference is the direct driving force for air to flow. If the internal air pressure is significantly different from external atmospheric pressure, any direct connection between the internal air and external atmosphere, no matter where it is in the building, may quickly lead air to flow from high pressure regions to low pressure regions and thus to reduce the pressure difference between the internal air and the external air.

There are two basic issues in interior air pressure control. The first is sealing the enclosed airway and the second is keeping the internal air refreshed. For the reason discussed above, without sealing the enclosed airway, air will leak through any kinds of interstices of the building, which makes it very difficult to maintain a significant pressure difference between the internal air and external environment. However, since air cannot freely flow in and out of a fully sealed construction we need to take special measures to keep the internal air refreshed.

In the past years, air pressure controls have mainly been applied in special restricted areas such as labs exposed to contaminated environment, patient rooms in hospitals that require special prevention of bacteria and other contaminants, or a manufacturing environment where cleaner air is necessary. For these special interests on special restricted areas, the prior arts of air pressure control have relied on complicated mechanical control systems to modulate the flow rates constantly in response to pressure fluctuations, which would be quite expensive to implement and maintain on a large scale and for significantly large pressure differences. Residential application of those implementations in territories like high altitude regions, where air pressure control is essentially meaningful to many people, could be too much luxury to be a common practice.

With the present invention, the application and maintenance of interior air pressure control systems in building constructions will not be much more expensive than the conventional building ventilation systems. This will make residential usage of air pressure control in need become economically practical.

According to hydrodynamic principles, during an air flow, air pressure is proportional to the square of the flow rate, which means that, as the flow driving force, the difference of pressure is not only proportional to the flow rate, but also proportional to the difference of the flow rate. This dynamic feature favors a rapid diminish of local pressure disturbance in an open air so that the air pressure will quickly reach equilibrium at a short distance from the source of disturbance.

But when air flows through porous media, the dynamic behavior of the flow is quite different from the behavior of air flowing in an open area. In his well known work in hydraulics, Henry Darcy discovered that when underground water flows through soil the hydraulic head drop (equivalent to hydraulic pressure drop) is proportional to the distance the water travels. This important law has been successfully extended to study flows through porous media in various other areas, not only for water flows but also for oil flows as well as gas and air flows.

With this Darcy's law, we realize that instead of using only the conventional construction materials, if we also use permeable porous walls for enclosing an airway, while a stable air pressure difference can be maintained across the porous walls, air can also flow in or out of the enclosed airway through the permeable porous walls. This is the main rationale behind the present invention.

SUMMARY OF THE PRESENT INVENTION

The present invention seeks to provide an interior climate control system to maintain a stable internal air pressure which is different from the air pressure in external environment (e.g. atmosphere) and the difference can be significantly large.

Different from any of the prior arts in building air pressure control, the present invention is defined by the partition of the total internal space into two separate airways by using Permeable Porous Walls. One of said airways is called peculiar airway where the air pressure is different from external environment air pressure (the difference can be significant), and the other of said airways is called normal airway where the air pressure is in equilibrium with the external environment air pressure.

Besides the connection to the normal airway through Permeable Porous Walls, the peculiar airway is connected to the external environment through at least one opening where means for driving air into or out of the airway mechanically are always installed.

In the normal airway, there is at least one free opening to the external environment so that the air pressure in the normal airway is in equilibrium with the external environment. In case that enhancement of air flow in the normal airway is desirable, besides the free openings, the normal airway could also optionally have some openings to the external environment where mechanical air driving means are installed.

Since the air pressure in a peculiar airway can be significantly different from the air pressure of external environment, in case the mechanical driving means, which is the driving force for maintaining the pressure difference, at any opening of said peculiar airway is not in function, the air may flow reversely in the opposite direction. To prevent this kind of reverse air flow, special means are installed in the air path of each said opening to the internal space of said peculiar airway to automatically block reverse air flow whenever said mechanical air driving means is not in function.

In the present invention, with a Permeable Porous Wall of known permeability and geometric sizes, the pressure difference across the porous wall can be maintained at a stable value through the self adjustment of air, and the value of the difference can be determined by the Darcy's law as follows:

$$P_p - P_n = Q \cdot h / A \cdot K,$$

where $P_p$ is the air pressure in the peculiar airway, $P_n$ is the air pressure in the normal airway, h is the thickness of the Permeable Porous Wall, A is the area of the Permeable Porous Wall, K is the permeability of the Permeable Porous Wall, and Q is the air ventilation rate.

For example, if the area of a Permeable Porous Wall is 100 $ft^2$, the thickness of said Permeable Porous Wall is 0.6 ft, and the permeability of said Permeable Porous Wall is 0.1 $ft^2$/sec·atm, then a 100 $ft^3$/min air ventilation rate will result in 0.1 atm (which is about the pressure of 1 meter deep water head) pressure difference across said Permeable Porous Wall.

Since the air pressure in the normal airway is in equilibrium with the external environment air pressure, a constant air pressure difference across the Permeable Porous Wall between the peculiar airway and the normal airway results in a constant air pressure in the peculiar airway which can be significantly different from the external environment air pressure.

People entering or leaving the peculiar airway through a door will cause air escape into or out of the peculiar airway because of the door operations. This will cause a disturbance to the air pressure in the peculiar airway, and thus a reduced pressure difference across the Permeable Porous Wall between the peculiar airway and the normal airway. This reduced pressure difference will in turn reduce the air flow through the Permeable Porous Wall. With the air supply or exhaust rate kept constant, the reduced air flow through the Permeable Porous Wall will by itself build up the pressure difference across the Permeable Porous Wall again automatically after the door is closed. With the present invention, no need to use special flow rate modulation mechanisms as used in prior arts to counteract the influence of door operations.

In order to maximally reduce the disturbance caused by door operations, the present invention includes a buffer space between each room in the peculiar airway and the space in normal airway for people to enter or leave the peculiar airway. The size of said buffer space is much smaller than the room in the peculiar airway. Each said buffer space has at least one door connecting to the peculiar airway, and at least one door connecting to the normal airway. Measures are taken so that said door(s) connecting to the peculiar airway and said door(s) connecting to the normal airway of said buffer space cannot be open at the same time.

The present invention provides a special systematic way of making the Permeable Porous Wall by taking into consideration the following factors:

First of all, the cost of the porous walls should be reasonably low; the second, a porous wall should be easy to replace when the wall wears out or is exposed to highly contaminated environment; and the third, reuse of the major materials of the porous walls should be possible and easy.

Based on these considerations, the present invention provides a special design of building a Permeable Porous Wall out of unit permeable porous blocks by assembling unit permeable porous blocks of same shapes and sizes together using block retainers, assembly frames, and a contouring frame.

While various materials such as metal and plastic foams can be used to make the unit permeable porous blocks, the present invention provides a special design of using unit boxes with at least two parallel permeable side faces and filled with granular particulates (e.g. sands) of desired size distributions to be the unit permeable porous blocks.

BRIEF DESCRIPTION OF THE DRAWINGS

FIG. 1A shows the scenario when the pressure in said peculiar airway is higher than the pressure in said normal airway, and FIG.1B shows the scenario when the pressure in said normal airway is higher than the pressure in said peculiar airway.

FIG. 2 is a schematic drawing showing the preferred embodiment of the reverse air flow blocking means for automatically blocking the reverse air flow. FIG. 2A shows the scenario of maintaining a higher pressure in the peculiar airway than the external air pressure and FIG. 2B shows the scenario of maintaining a lower pressure in the peculiar airway than the external air pressure.

FIG. 4 shows an example of the unit box to be used as the unit permeable porous block when filled with particulates.

FIG. 6 provides a view showing how the block retainers themselves are assembled from some basic units.

DETAILED DESCRIPTION AND A PREFERRED EMBODIMENT

Figure 1:
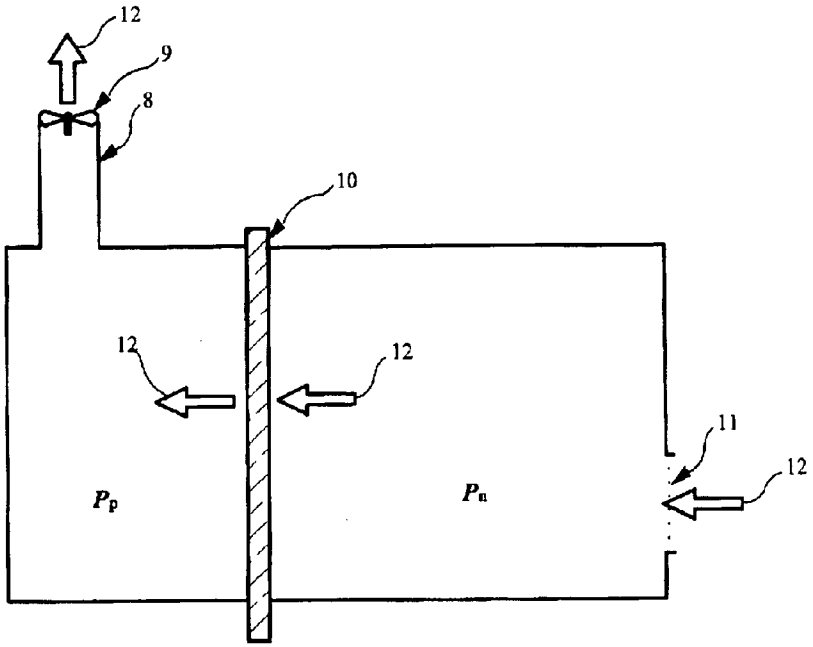
FIG. 1 is a schematic drawing showing the partition of an airway into a peculiar airway and a normal airway by using a Permeable Porous Wall.
Figure 1:
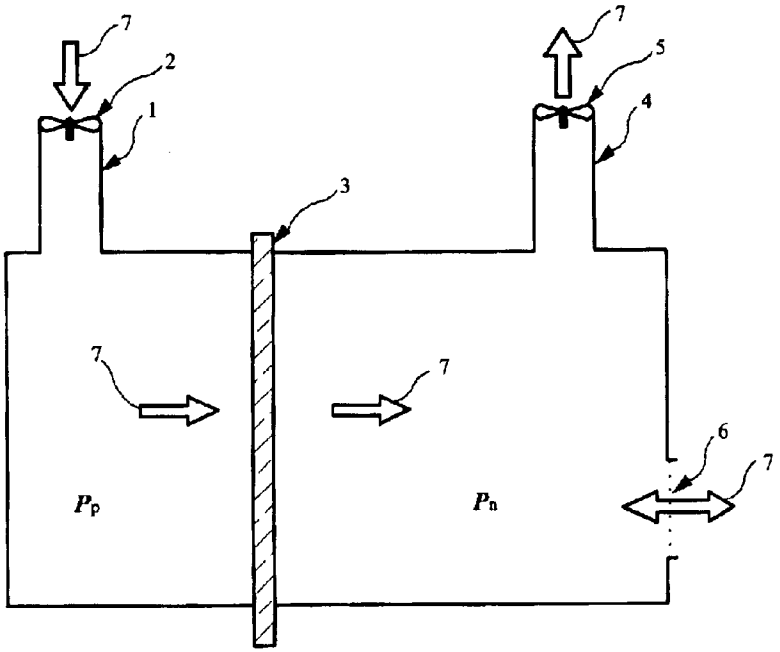

In FIG. 1A, air (denoted by number 7 in the FIG) is driven by mechanical means 2 into the peculiar airway through opening 1 and then flows through the Permeable Porous Wall 3 to the normal airway, which maintains a higher air pressure $P_p$ in the peculiar airway than the air pressure $P_n$ in the normal airway. In the normal airway, opening 4 with mechanical air driving means 5 is optionally added to the system to help drawing non-fresh air out of the normal airway. At the free opening 6, air can flow into or out of the normal airway depending on how the mechanical means 5 at opening 4 functions.

In FIG. 1B, air (denoted by number 12 in the FIG) is drawn out of the peculiar airway by mechanical means 9 at opening 8, which creates a lower air pressure in the peculiar airway so that the air in the normal airway is sucked into the peculiar airway through the Permeable Porous Wall 10. Since in this scenario, the non-fresh air in the peculiar airway does not get into the normal airway through the Permeable Porous Wall and fresh air is sucked into the normal airway through opening 11, there is no need to have an opening like the opening 4 in FIG.1A for mechanically enhancing the air flow.

In the scenarios of both FIG. 2A and FIG. 2B, a plate of the same shape and size as the main sectional area of the ventilation duct to the opening of the peculiar airway is installed with its one edge connected to the duct at position 0. The plate is free to turn around the axis 0 within certain angle range to open and block the air path of the duct.

FIG. 2A shows that when air (denoted by number 16 in the FIG) is driven into the peculiar airway by mechanical means 13 at an opening, the air flow pushes the plate to position 15, and the air path is open. In case the air driving means 13 at the opening is turned off, because the air pressure in the peculiar airway is higher than the external environment air pressure, the internal air will tend to reversely flow toward the opening, which will push the plate to position 14 to close the air path so that the internal air pressure can be maintained higher than the external atmospheric pressure.

FIG. 2B shows that when air (denoted by number 20 in the FIG) is drawn out of the peculiar airway into the external environment by mechanical means 17 at an opening, the air flow pushes the plate to position 19, and the air path is open. In case the air driving means 17 at the opening is turned off, because the air pressure in the peculiar airway is lower than the external environment air pressure, the external air will tend to reversely flow into the peculiar airway through the opening, which will push the plate to position 18 to close the air path so that the internal air pressure can be maintained lower than the external environment air pressure.

Figure 3:
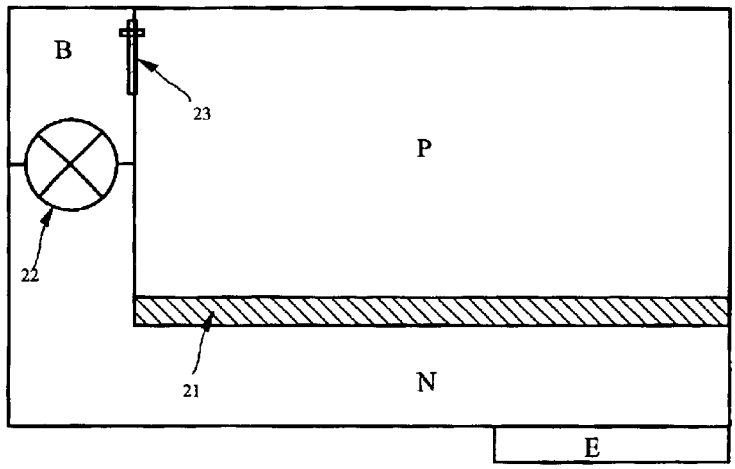
FIG. 3 is a schematic plan view demonstrating the partitioning of an interior space into a peculiar airway and a normal airway with a very simple example of preferred embodiment.

In FIG. 3, space P is a room in the peculiar airway, space N is the normal airway space, room P and space N is separated by a Permeable Porous Wall 21, space B is a buffer area between room P and space N for people to move between room P and space N. Door 22 is a revolving door between space N and space B, door 23 is between space B and room P, E is the main entrance to the construction from outside.

The function of space B is to reduce the pressure fluctuation in room P due to people movements between room P and space N. In FIG. 3, door 23 is opened from the side far from the revolving door 22, which disfavors the simultaneous operations of both door 22 and door 23. However, this is not the only way to disfavor the simultaneous operations of both door 22 and door 23. Actually, we can have some mechanical means to disallow the simultaneous operations of both door 22 and door 23. The size of space B should be much smaller than the size of room P so that the pressure fluctuation in room P due to each operation of door 23 can be limited to a small percentage of the pressure in room P. For example, if the air pressure in space N is 80% of the air pressure in room P, and the size of space B is 10% of the size of room P, then the pressure fluctuation in room P due to one operation of opening and closing door 23 will be less than 2% of the air pressure in room P.

FIG. 4A is a 3D schematic drawing showing an example of preferred embodiment of the unit box, which is composed of 2 parallel permeable square screens as its front and back faces, and 4 impermeable plates as its bottom, top cover, and 2 side faces. FIG. 4B shows the permeable square plate used as the front and back faces of the box, which is composed of a permeable screen in the center and an impermeable outer frame to hold the screen. FIG. 4C shows the impermeable plate used as the bottom, top cover and side faces of the box. Since the front and back faces are squares in FIG. 4A (as shown in FIG. 4B), the plates for other faces of the box are of the same size.

When used to build the Permeable Porous Wall, the unit boxes are filled with particulates of selected size distribution. One kind of preferred particulate materials that can be used in the unit permeable boxes are natural sands.

Figure 5:
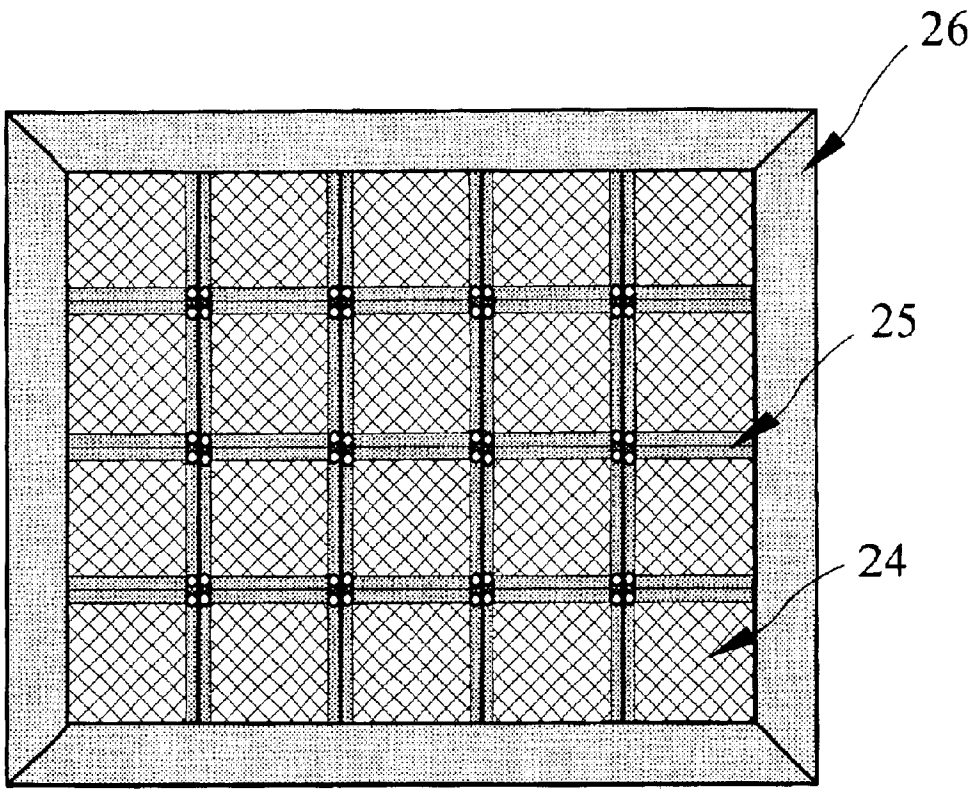
FIG. 5 provides a front view of an assembly of the unit permeable blocks.

Once the unit boxes are filled will the pre-sorted particulates, they are assembled together as shown in FIG. 5.

FIG. 5 provides a front view of an assembly of unit blocks. There are three layers in the assembly. The innermost layer 24 is the layer of the unit blocks, the middle layer 25 is the layer of block retainers that are used to retain the blocks from falling out of the assembly, the outermost layer 26 is the assembly frame used to hold the blocks and retainers together.

FIG. 6A shows an example of the basic retainer unit that is a square frame with 4 holes at the corners. FIG. 6B shows two retainer units connected together by two connection braces at two corners of both units. FIG. 6C shows a plurality of retainer units connected together forming a retainer column. FIG. 6D shows a plurality of retainer columns connected together forming a retainer plane.

An assembly as shown in FIG. 5 can not itself be used as a wall because the shapes and sizes of real walls are not standardized around the world. For a room where we want to use a Permeable Porous Wall to partition the airway, we need to have a tailor-made contouring frame of the shape of a real wall and fit assemblies of the porous blocks as shown in FIG. 5 into said tailor-made contouring frame, and then use this tailor-made contouring frame as the Permeable Porous Wall and install it in the room. The final assembling work of a Permeable Porous Wall can be done right on the site where the wall is to be installed.

Figure 7:
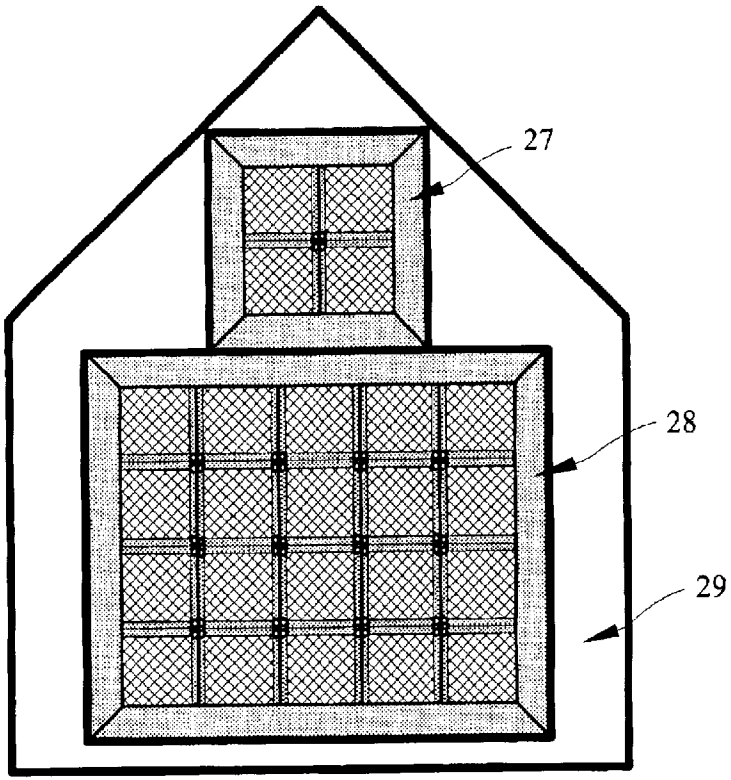
FIG. 7 shows an example of the contouring frame.

In FIG. 7, 27 and 28 denote two assemblies of porous blocks and 29 denotes the tailor-made contouring frame of the shape of a real wall.

From FIG. 7 we can see that the effective permeable area of a Permeable Porous Wall is smaller than the total area of the entire wall. Therefore, when we use Darcy's law to estimate the required permeability of a porous wall for some desired flow rate and pressure difference, we need to use the effective permeable area instead of the total wall area in the calculation.

By assembling the whole Permeable Porous Wall from unit blocks, we not only make the replacement of part of the wall or the whole wall very easy, but also make it possible to reuse as much as possible the materials that are still in good conditions when a replacement is needed. The filling particulates for the unit boxes (e.g. sands) are also highly reusable.

Figure 8:
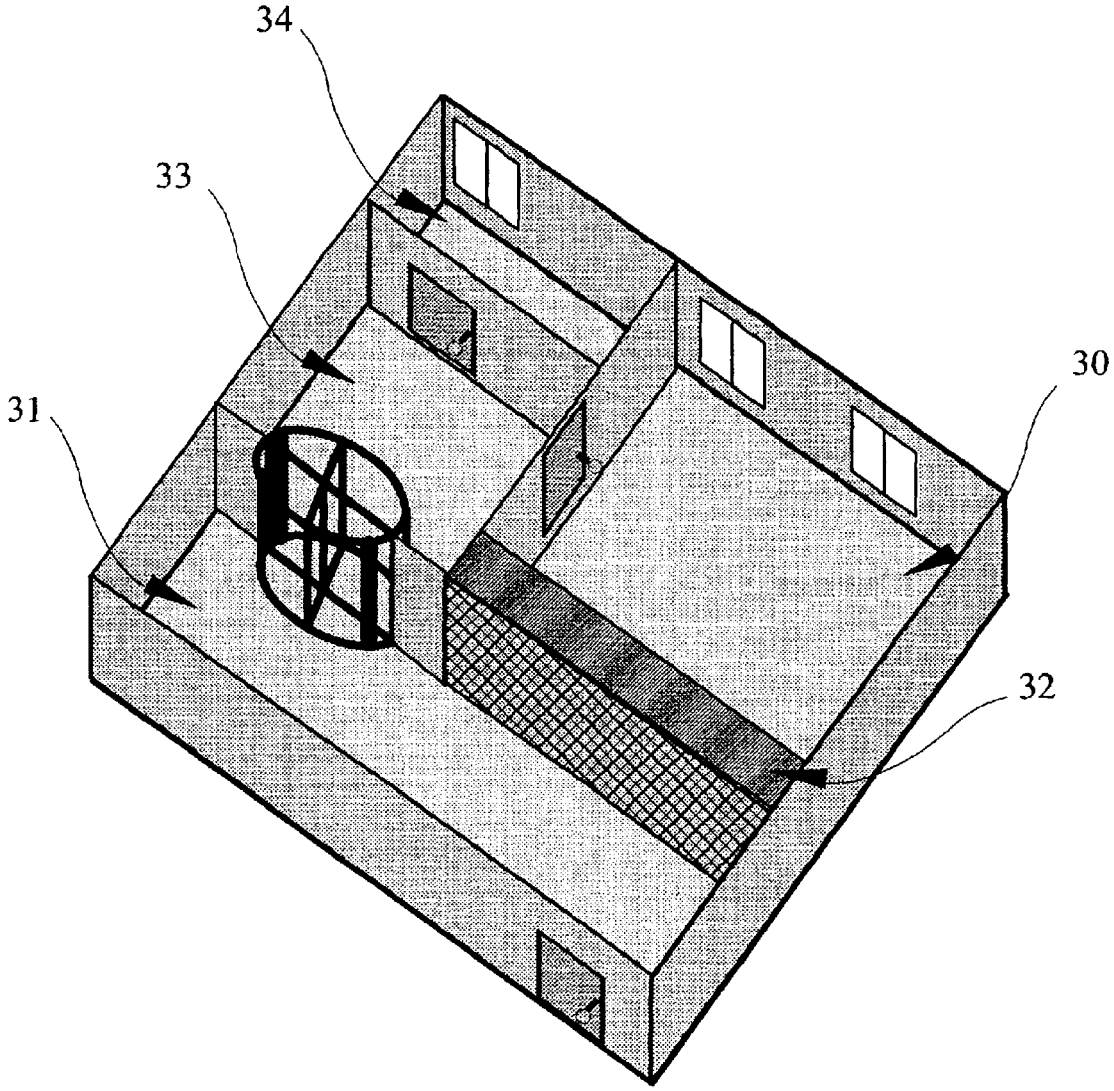
FIG. 8 is a 3D schematic drawing showing the top view of an example of preferred embodiment of airway partitioning including the use of buffer space.

FIG. 8 provides a 3D schematic view of an example of preferred embodiment of airway partitioning including the use of buffer space as designed by the present invention.

In FIG. 8, a Permeable Porous Wall 32 is between the room 30 that is in the peculiar airway, and the space 31 that is in the normal airway. Room 33 is a buffer space for people to move between space 31 and room 30. Room 34 is a wash room. There is a front entrance door for people to enter the house. Between the space 31 and the buffer room 33 is a revolving door. In this example the wash room 34 and the bedroom 30 is not directly connected. People have to go through the buffer room 33 to enter the wash room. This separation of the wash room from the bedroom can prevent the air in the peculiar airway from leaking through the toilet and sinks. Technically this makes the design work easier but is not a necessary thing to do. By taking some special measures to prevent air leaking through the toilet and sinks, we can directly connect the wash room with the peculiar bedroom.

Figure 9:
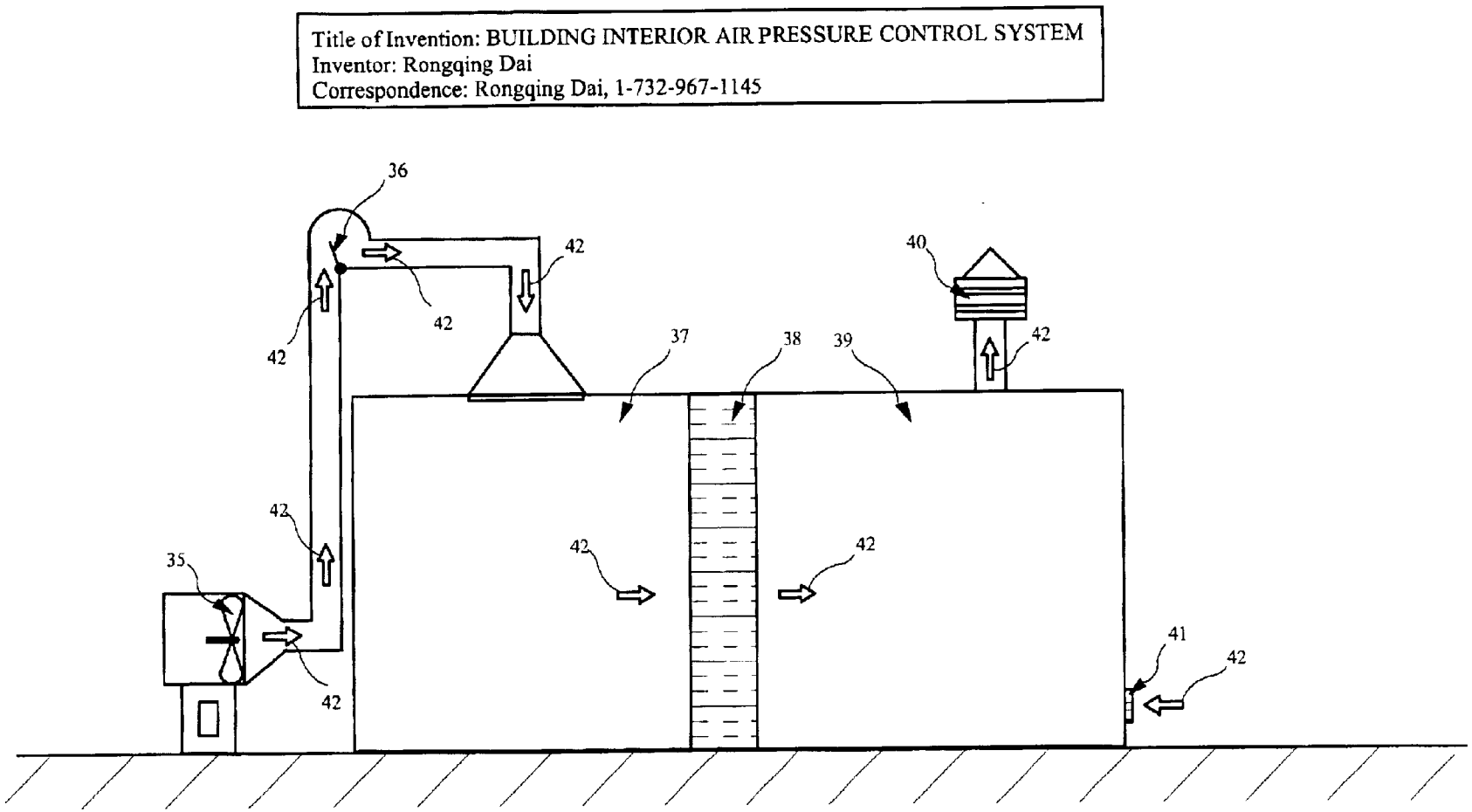
FIG. 9 is a schematic drawing showing the duct work for the example embodiment of FIG. 8.

FIG. 9 is a schematic drawing showing the duct work for the example embodiment.

In FIG. 9, air (denoted by number 42 in the FIG) is driven by mechanical means 35 into the duct, and pushes the reverse air flow blocking plate 36 to open the air path, then enters the space 37 in the peculiar airway, and flows through the Permeable Porous Wall 38 and enters the space 39 in the normal airway, and is sucked to the outside atmosphere through the roof ventilator 40. There is also a free opening 41 in the normal airway where the outside fresh air enters into the construction.

What is claimed is:

1. A method for maintaining building interior air pressure that is different from external environment air pressure comprising:

a. partitioning the internal airway of a building using a permeable porous wall or a plurality of permeable porous walls into a peculiar airway where air pressure is different from external environment air pressure (the difference can be significantly large), and a normal airway where air pressure is in equilibrium with external environment air pressure;

b. driving air into or out of said peculiar airway mechanically through at least one opening connecting said peculiar airway to external environment;

c. connecting said normal airway directly to external environment through at least one free opening.

2. The method of claim 1, wherein reverse air flow blocking means is installed in the air path between said peculiar airway and each of said openings of said peculiar airway where mechanical means is installed to drive air into or out of said peculiar airway.

3. The method of claim 1, wherein at least one buffer room that is much smaller than the size of said peculiar airway is built between said peculiar airway and said normal airway for people to move between said peculiar airway and said normal airway.

* * * * *